United States Patent [19]

Wilbur et al.

[11] 3,958,148

[45] May 18, 1976

[54] RADIO FREQUENCY NOISE GENERATING MAGNETRON

[75] Inventors: Donald A. Wilbur, Albany; Philip H. Peters, Jr., Schenectady, both of N.Y.

[73] Assignee: General Electric Company, Schenectady, N.Y.

[22] Filed: Aug. 11, 1952

[21] Appl. No.: 303,725

[52] U.S. Cl. ..... 315/39.65; 315/39.75; 331/78

[51] Int. Cl.[2] ..... H01J 25/50

[58] Field of Search ..... 250/36–39, 250/9.1; 315/39, 40, 39.65, 39.75

[56] References Cited

UNITED STATES PATENTS 2,679,615 5/1954 Bowie ..... 315/40

OTHER PUBLICATIONS

"A Tunable Squirel Cage Magnetron", 4/47, pp. 362–369, Proc. of I.R.E., Vol. 35, No. 4.

*Primary Examiner*—T. H. Tubbesing

*Attorney, Agent, or Firm*—Jerome C. Squillaro; Joseph T. Cohen

EXEMPLARY CLAIM

1. A magnetron discharge device for noise generation comprising an elongated cathode, a plurality of spaced anode segments surrounding said cathode to define a cylindrical space charge chamber, and means for establishing a radial electric field between said cathode and said anode segments for imparting an average rotational velocity about the cathode to an electronic space charge when a magnetic field is axially directed through the space charge chamber, said spaced segments and the gaps between them differing in relative widths whereby electrons traveling under different segments and gaps have different transit times.

12 Claims, 8 Drawing Figures

Inventors:
Donald A. Wilbur,
Philip H. Peters, Jr.
by Paul A. Frank
Their Attorney.

Inventors:
Donald A. Wilbur,
Philip H. Peters, Jr.

by Paul A. Frank
Their Attorney.

RADIO FREQUENCY NOISE GENERATING MAGNETRON

Our invention relates to magnetrons for producing high frequency noise signals.

Radio frequency noise has been commonly used to jam enemy radar. Noise in this sense is understood to refer to an electrical signal having components which vary randomly in frequency and amplitude in a frequency band including the frequency of the signal to be jammed. A common method employed for producing such noise at satisfactory power level has required wide band amplification of the output of a low level noise source, which output signal is then employed to amplitude modulate a magnetron oscillator. However successful such a jamming equipment, it obviously requires a relatively complex apparatus. In aircraft installations especially, where bulk and weight must be minimized, the amount of equipment required for the separate noise source and the associated amplifiers and modulation equipment limits the feasibility of jamming equipment installation.

It is an object of our invention to provide a simple and efficient means for generating radio frequency noise at substantial power levels with a minimum amount of equipment.

It is another object of our invention to provide a magnetron discharge device for the generation of high frequency noise signals.

According to our invention, a magnetron of the type having a plurality of spaced anode segments surrounding an elongated cathode is employed to generate radio frequency noise at substantial power levels of the same order of efficiency as may be obtained for coherent oscillation. To realize this result the transit time of the magnetron space charge between the various anode segments is made to differ in different parts of the magnetron so that a high level of noise power can be generated in an applied voltage range below that necessary for coherent oscillation. According to one aspect of our invention this is achieved by varying the distances between the midpoints of adjacent anode segment gaps. In the exemplary embodiments described in detail in our application, we have described configurations designed to produce both angular and axial variations of the space charge transit time between segments.

Before proceeding to a detailed description of apparatus embodying our invention, a brief consideration of the nature of noise in magnetron operation is pertinent. In a conventional magnetron oscillator of the traveling wave type, whether the magnetron device be one having a number of individual anode segments or vanes which are connected to a resonant circuit or circuits or whether it is one in which the anode segments are part of an anode block in which a plurality of cavity resonators are incorporated, the resonant system is excited by the properly timed or synchronized passage of bunches of electrons past the anode segments. The average velocity of the electrons past each segment determines the gap-to-gap transit time. In the pre-oscillation period of a magnetron when oscillations are being initiated, it is believed that the random movement of some of the electrons of the rotating space charge helps to start oscillations over a band of frequencies in the resonant system. The net effect of all the random excitation of the various resonators or parts of the resonant circuit is described as high frequency noise. When additional voltage is applied to the magnetron anode segments, the amplitude of the individual high frequency fields increases. This results in the phase focusing and synchronization of the space charge required for coherent oscillation. Conventional magnetrons are designed to produce maximum power output and efficiency for coherent oscillation and minimum noise-to-signal ratio. While noise occillations have been observed in such magnetrons, the noise power has been but a small fraction of the total power output. It has heretofore been assumed impossible as well as undesirable to obtain a substantial noise output from a magnetron oscillator, and a more adequate theory and explanation of the general principles of magnetron operation as directed to the increase of noise output have not been available.

The production of noise may be satisfactorily explained, so far as an understanding of our present invention is concerned, by considering the relative spacing and configuration of the anode segments with respect to each other and the cathode, in terms of the resulting angular and axial variation of the electric fields between them. The variation of gap-to-gap transit time of the bunched electrons may be considered as a starting point in determining the asymmetry of anode configuration desirable for production of noise signals. The net effect of the changes in magnetron construction for production of a substantial noise output may be viewed as increasing the width of the band of preoscillation noise frequencies, thus rendering synchronization of the high frequency voltages more difficult so that substantially only a noise output is obtained at maximum rated power inputs to the magnetron, the ratio of noise to coherent oscillation being so large as to render the coherent signal unrecognizable. Reference is also made to our related application Ser. No. 303,726, filed Aug. 11, 1952 (concurrently herewith) and assigned to the assignee of the present invention, where asymmetry of the electric field due to cathode construction and location is utilized in the direct generation of high frequency noise as described and claimed herein.

The features of the invention desired to be protected herein are pointed out in the appended claims. The invention itself together with its further objects and advantages may best be understood by reference to the following description, taken in conjunction with the accompanying drawing, in which:

Figure 1:
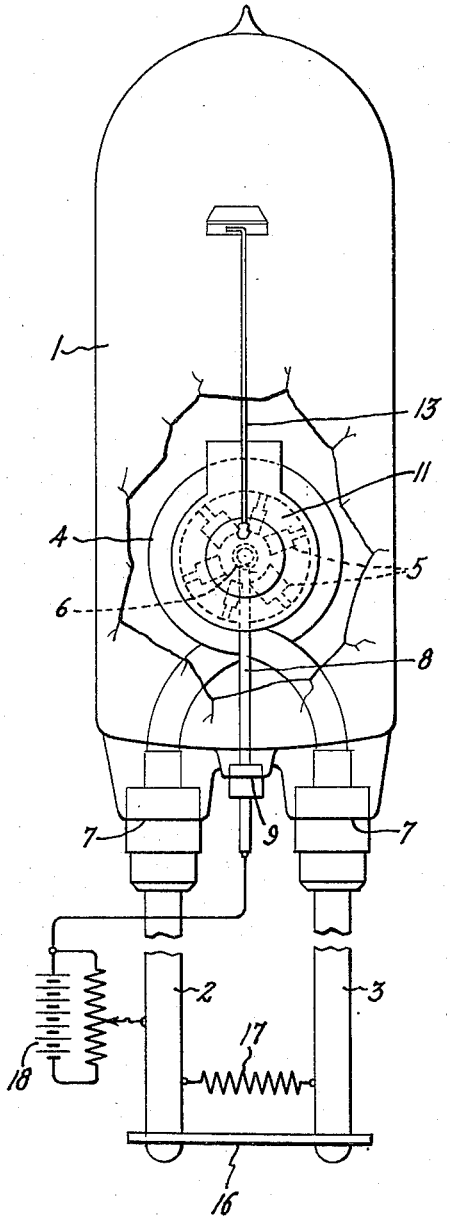
FIG. 1 represents a view, partly in section, of a magnetron discharge device and circuit connection therefor embodying the principles of the invention.
Figure 2:
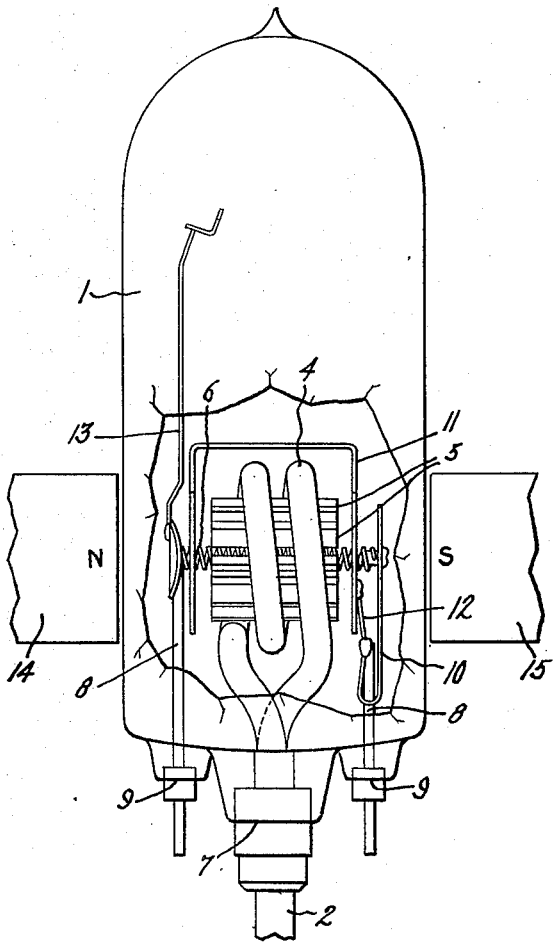
FIG. 2 is another view, partly in section, of the device of FIG. 1.
Figure 4:
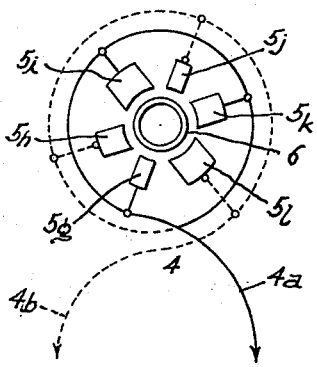
Figure 5:
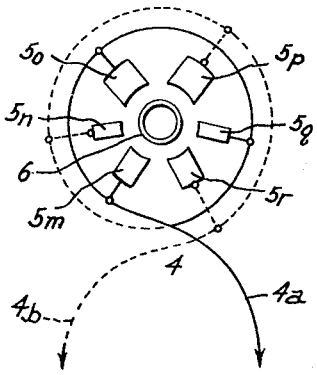
Figure 6:
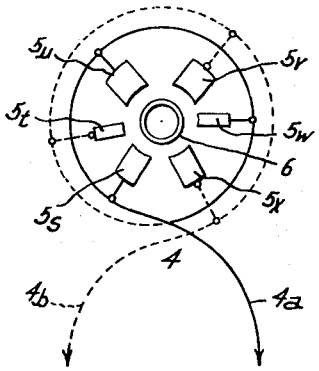
Figure 7:
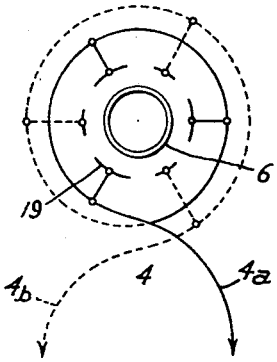
Figure 8:
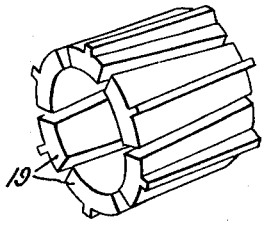

FIGS. 4, 5, and 6 are views of magnetron electrode structures representing modifications;

FIG. 7 is a schematic representation of the electrode structure of another magnetron embodying the invention; and FIG. 8 is a perspective view of the anode structure of FIG. 7. Referring now to FIGS. 1 and 2, a magnetron structure of the interdigital type is shown as modified for noise generation. Except for the gap-to-gap spacings of the anode segments thereof, the magnetron structure corresponds to that described and claimed in U.S. Pat. 2,521,556, issued Sept. 5, 1950 to Donald A. Wilbur and assigned to the assignee of the present invention.

In this type of magnetron a hermetically sealed envelope 1, suitably made of glass, encloses a part of a resonant circuit such as a transmission line section comprising parallel conductors 2 and 3 which extend through the base of the envelope 1 and a two-turn helical coil 4 which terminates the conductors. Within the helical coil 4 are provided a plurality of anode electrodes 5, each of which is conductively supported from a different point on the inner periphery of the spiral as by welding thereto. These anode electrodes, also commonly called segments or vanes, define a generally cylindrical chamber between the inner surfaces which is coaxial with a centrally disposed cathode 6. The cathode is preferably of the thermionic type and in the drawing is shown as comprising a spiral tungsten coil which is coated with a suitable thermionic emissive material, such as barium oxide, for providing an electronic space charge.

Still referring to FIGS. 1 and 2, suitable glass-to-metal seals 7 surrounding the lines 2 and 3 permit them to be hermetically secured to the envelope wall. Similarly, conductive connections are made to the cathode coil 6 by a pair of upright conductive rods 8 which also pass through the envelope base at similar glass-to-metal seals 9. One end of the cathode coil 6 is preferably rigidly attached to one of the support rods 8 and the other end is attached to a spring tension member 10 which is rigidly secured to the other cathode support rod. In this way the cathode 6 is held taut and fixed in its position relative to the spiral and the anode structures. To forestall destructive bombardment of the envelope 1 by electrons escaping from the space charge chamber a cathode end-shield arrangement 11 having end members positioned near the ends of the space charge chamber defined by the anode segment array is provided. This end shield assembly is suitably positioned and supported by a support 12 welded to it and to a cathode support rod 8. A suitable getter is provided on a getter support 13 also supported from one of the cathode support rods 8. The getter is flashed according to well known techniques during evacuation of the envelope.

Figure 3:
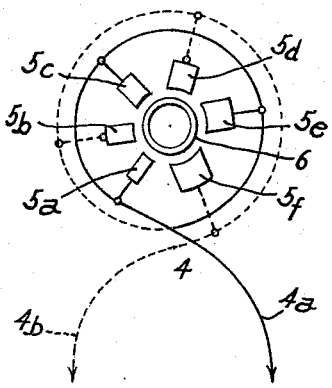
FIG. 3 represents an enlarged view of the electrode structure of FIG. 1.

As may be seen more clearly in FIG. 3, the array of six anode segments 5, further identified separately as segments 5*a* to 5*f*, are connected so that adjacent segments may be at opposing high frequency potentials when the resonant circuit including the spiral coil is excited at its resonant frequency. Accordingly, one set of alternate segments, namely 5*a*, 5*c* and 5*e*, are connected to one turn of the coil which is indicated schematically as 4*a* in FIG. 3, and the other set of alternate segments 5*b*, 5*d* and 5*f* are connected to the other coil turn 4*b*. When one lengthwise half of the coil becomes electrically positive and the other negative, the segments of the anode array are alternately positive and negative corresponding to the usual pi mode of excitation. Other means of interconnecting anode segments or of providing the resonant circuits between them may be utilized instead, this particular construction being exemplary of magnetron arrangements in which the invention may be incorporated.

In operation a static magnetic field is provided in the space charge chamber parallel to the axis thereof. Means for providing such a field is illustrated in FIG. 2, as the north and south poles 14 and 15 respectively of a permanent magnet positioned outside the envelope and aligned with the cathode. Other means of providing the magnetic field, such as a solenoid winding, may, of course, be substituted. To provide the space charge in the space charge chamber a suitable source of heater voltage is provided between the cathode terminals 8, the amount of current being regulated to provide a high cathode temperature for large or heavy electronic emission.

As further shown in FIG. 1 the resonant circuit to which the anode segments are coupled as previously described is tuned to a desired frequency by positioning a short circuiting conductor 16 between the paralled transmission line conductors 2 and 3 at the desired position along the length thereof. A load 17, schematically indicated as a resistor, is also coupled between the conductors 2 and 3. To provide a radial electric field in the space charge chamber, a source of direct current voltage 18 is connected between the cathode and the anode assembly.

The radial electric field, together with the axial magnetic field, imparts a generally rotating motion to the electronic space charge so that it assumes an average angular velocity about the cathode. In a conventional magnetron where the gap-to-gap spacing of the anode assembly is uniform the random or noise excitation of the resonant circuit coupled to the anode segments establishes high frequency fringing electric fields between the segments with which the space charge interacts. The space charge in typical magnetron oscillator operation is bunched or focused in phase so that in-phase or useful electrons crossing the anode gaps in phase with the fringing high frequency electric field give up some of their kinetic energy to that field while the out-of phase electrons are accelerated and returned to the cathode.

Under such conditions in conventionaal oscillators the space charge is synchronized with the alternating fields of the anode assembly so that any given bunch of in-phase electrons of the rotating space charge arrives at each interaction gap in phase with the alternating field in the gap region. As the applied voltage between the anode and cathode is increased beyond the point where coherent oscillation begins, the electronic space charge tends to exceed the synchronous velocity with the result that more energy is transferred from the direct current source through the space charge to the alternating fields of the resonant output system. For high power an anode voltage in excess of that voltage required for the initiation of oscillation is provided. The output circuit impedance is also kept sufficiently high to facilitate power transfer to the desired load and to prevent attenuation of the alternating electric field below a value necessary for effective synchronization of the rotating space charge.

According to our invention the production of useful high frequency noise is facilitated by providing the anode segments 5 with different widths so as to provide different lengths of travel between the midpoints of adjacent gaps. As may be seen most conveniently in FIG. 3, the anode segments 5*a* through 5*f* are all of different widths ranging in the embodiment shown from a segment of minimum width 5*a* to a segment of maximum width 5*f*, twice that of the minimum width. The variation in width is substantially greater than any permitted by the manufacturing tolerances of conventional magnetrons utilized as coherent oscillators. The maximum ratio is preferably less than that for which all of the anode segments, and hence all of the anode gaps, would not be utilized in noise excitation of the resonant output system, a 2:1 ratio, measuring from mid-gap to mid-gap, representing an approximate ratio in magnetrons of this general type. In other words, if the electron transit times under the various segments were to be too divergent, the resultant inability to transfer power from the electron stream to the output circuit would cause the apparatus to lose its identity as a magnetron oscillator. Since the anode segments are of different widths, the transit times of the space charge under the different segments is modified as the space charge tends to assume a uniform average angular velocity about the cathode. Accordingly, the gap-to-gap transit times vary along the space charge path with the result that the space charge is not readily phase-focused and synchronized to a single output frequency. Instead, the various random oscillations produced by the unsynchronized space charge and known as noise are maintained without falling into a coherent oscillation pattern, even when the applied anode voltage is increased to produce the power output corresponding to the output rating of a conventionally arranged magnetron of the same dimensions.

It should be understood that the term "gap width" referred to herein refers to travel distance of the space charge under the anode segment and not to the axial length of the axial segment along the cathode. This width may also be described in terms of angle subtended to the cathode axis. Thus in a conventional six vane or six segment magnetron, the angle subtended by each segment, or more accurately, the angle subtended between the midpoints of adjacent gaps is 60°, whereas in the arrangement of FIG. 3 the angle varies from approximately 30° to 90° degrees. While the anode segments have been illustrated as arrayed in an order of increasing or decreasing the gap width according to the chosen direction of space charge rotation, this specific order is not necessary to the production of noise and the anode segment arrangement may be entirely random so far as the selection of the widths is concerned.

For optimum extension of the noise producing range of noise generators embodying our invention the cathode emission and the output circuit characteristics must both be controlled as described in the following paragraphs.

Assuming a given electric field condition in the magnetron of FIGS. 1, 2 and 3, the difficulty of phase-focusing the space charge and of synchronizing the space charge bunches increases with the density of the space charge. Accordingly, it is desirable that the cathode emission be heavy to maintain noise production as the power input to the magnetron is increased. This may be suitably achieved by various well known means such as increasing the temperature of the thermionic cathode.

Conversely, assuming a given space charge, synchronization is forestalled by preventing the voltage amplitude of the induced noise signal components from building up to a high value as the input power is increased. One way in which this may be accomplished is by increasing the resistive loading of the tuned input circuit, as by decreasing the resistance of resistor 17 of FIG. 1 to a value below that employed for high power coherent oscillations of a conventional magnetron, or by suitably changing the resistor position on the resonant circuit. Such an output circuit is characterized as a high decrement circuit since its stored energy is rapidly dissipated, and its bandwidth or breadth of tuning is also necessarily increased as a result of the loading. Another way in which the production of noise is maintained is by increasing the bandwidth through addition or rearrangement of the reactive components of the output system, as by a filter means or multiple tuned circuits. In this case the circuit could have both a low decrement and a broad bandwidth. The nature of the production of the noise is believed to differ to some extent according to whether the decrement is high or low. Since in either extreme or for an intermediate case the output circuit is not sharply tuned, the circuit is believed aptly described as broadly tuned.

The concept which is believed to be properly descriptive of the mechanism of noise generation also further explains the output circuit requirements for high power noise generation. During the pre-oscillation period the random excitation of the resonant system may result in simultaneous excitation of the resonant system at different frequencies, within its bandwidth, the oscillations also differing in phase and amplitude. This may readily occur since the electrons of the space charge under the excitation gaps may have many different velocities across the excitation gaps between the different segments and since the resonant output circuit is tuned sufficiently broadly to permit response to a band of frequencies on either side of the center frequency. If the circuit is dissipated at a relatively high rate, the resultant excitation by the space charge at all these frequencies tends to produce a net voltage of zero for a time long enough for the circuit oscillations to be damped out. There is, therefore, no high frequency anode voltage to maintain that particular space charge configuration. Thus, before oscillations have an opportunity to build up and cohere at a particular frequency, they are damped out, permitting the other unrelated oscillations to start and be damped.

If the resonant output circuit has a low decrement rate and a sufficient bandwidth, the noise oscillations tend to shift in frequency as they attempt to build up, the stored energy of the output circuit being available to support noise oscillations of different frequencies. This introduces frequency modulation components into the noise output signal. Then the various frequency components of the space charge need alter only the rate of exchange of energy between the capacitance and inductance of the output circuit. Since the frequency and rate of change of frequency are random, the frequency modulation components vary randomly and maybe used to jam receiving devices sensitive to frequency modulated signals. The impedance of the low decrement circuit may readily be established at a sufficiently high value for maximum power transfer.

Referring now to FIG. 4, another schematic representation of a magnetron electrode structure corresponding to that shown in FIG. 3 is illustrated except that the anode segments 5 are arranged somewhat differently in width than those of FIG. 3. Accordingly, six anode segments **5*g* to 5*l* are shown in circular array with oppositely disposed segments of the same width. Accordingly, as illustrated for this embodiment, segments 5g, 5h and 5*i* are arranged in an order of increasing width for a clockwise rotation about the cathode and the following segments 5*j*, 5*k* and 5*l* are similarly dimensioned and arranged. As in FIG. 3,** the ratio of maximum to minimum segment width may satisfactorily be as much as 2:1.

Another modification is illustrated in FIG. 5 where segments **5*m* to 5*r* are arranged in circular array about a centrally disposed cathode 6. As in FIG. 5 three pairs of anode segments are employed ranging in width from a small, intermediate and large size. The two narrowest width segments 5***n* and 5*q* are oppositely disposed, the intermediate width segments 5*m* and 5*r* being adjacent to each other as are also the large segments 5*o* and 5*p*.

In each of these modifications described, noise power output is obtained at high power levels. It may be seen that no particular sequence or spacing is necessary for the desired operation. Likewise it should be understood that the number of segments illustrated in the anode array is only illustrative. However, in order to obtain sufficient asymmetry and to prevent coherent oscillation at low power levels, it is desirable that the number of anode segments be four or more.

Referring now to FIG. 6 an anode array similar to that of FIG. 5 is shown in which segments 5*s* to 5*x* surround a cathode 6 but are not uniformly spaced from each other so as to provide interaction gaps between the segments of varying lengths. In this way the gap-to-gap transit time, that is the time to travel between the midpoints of adjacent gaps is increased or decreased due to variations in the gap widths themselves. This variation of gap widths may, of course, be applied on other anode arrangements than the one illustrated in FIG. 6 and is believed further useful in producing noise so far as distortion and asymmetry of the radical electric field due to the imposed anode voltage is increased due to the variations in the gap widths.

Referring now to FIGS. 7 and 8 an anode arrangement is illustrated for producing axial variations of the gap transit times so that the transit time differs for different portions of the space charge depending on the axial position of the space charge in the space charge chamber as well as its position in the space charge chamber transverse to the space charge chamber axis. In FIG. 7 coil or loop 4 having turns 4*a* and 4*b* similar to the coil arrangement of FIG. 1 and 2 is positioned around the centrally disposed cathode 6. The anode segments 19, however, are each of varying widths along their axial length. The top view, represented schematically at FIG. 7 shows segments of alternately wide and narrow width, and as further shown in the perspective view of the anode assembly in FIG. 8, each of the segments may actually be the same size for ease of construction, the direction of taper or decrease in width being reversed from segment to segment. While this particular means of axial variation is illustrated for ease of fabrication, the different segments may be of different sizes and may have different gaps between them in accordance with the principles previously discussed. If desired, the axial variation of the segments may also be combined with the arrangements previously illustrated.

While the present inventon has been described by reference to particular embodiments thereof, it will be understood that numerous modifications may be made by those skilled in the art without actually departing from the invention. I, therefore, aim in the appended claims to cover all such equivalent variations as come within the true spirit and scope of the foregoing disclosure.

What we claim as new and desire to secure by Letters Patent of the United States is:

1. A magnetron discharge device for noise generation comprising an elongated cathode, a plurality of spaced anode segments surrounding said cathode to define a cylindrical space charge chamber, and means for establishing a radial electric field between said cathode and said anode segments for imparting an average rotational velocity about the cathode to an electronic space charge when a magnetic field is axially directed through the space charge chamber, said spaced segments and the gaps between them differing in relative widths whereby electrons traveling under different segments and gaps have different transit times.

2. A magnetron discharge device for noise generation comprising an elongated cathode, a plurality of spaced anode segment surrounding said cathode to define a cylindrical space charge chamber, means for establishing a radial electric field between said cathode and said anode segments for imparting an average rotational velocity about the cathode to an electronic space charge when a magnetic field is axially directed through the space charge chamber, said spaced segments and the gaps between them differing in relative widths whereby electrons traveling under different segments and gaps have different transit times, and a broadly tuned resonant output circuit coupled to said segments.

3. A magnetron discharge device for noise generation comprising an elongated cathode, a plurality of circumferentially spaced anode segments surrounding said cathode to define a cylindrical space charge chamber, and segments defining gaps therebetween means for establishing a radial electric field between said cathode and said anode segments for imparting an average rotational velocity about the cathode to an electronic space charge when a magnetic field is axially directed through the space charge chamber, said spaced segments and the interposed gaps having such widths that more than two successive gap-to-gap spacings are different whereby electrons traveling under different segments and gaps have different transit times.

4. A magnetron discharge device for noise generation comprising an elongated cathode, a plurality of spaced anode segments surrounding said cathode to define a cylindrical space charge chamber, means for establishing a radial electric field between said cathode and said anode segments for imparting an average rotational velocity about the cathode to an electronic space charge when a magnetic field is axially directed through the space charge chamber, the gaps between the spaced segments differing in relative widths whereby electrons traveling under different segments and gaps have different transit times.

5. A magnetron discharge device for noise generation comprising an elongated cathode, a plurality of anode segments surrounding said cathode to provide a space charge chamber therebetween, said segments defining gaps therebetween said segments and the interposed gaps having such dimension that more than two successive gap-to-gap spacings are different from one another, and means for coupling said segments to a common output circuit.

6. A magnetron discharge device for noise generation comprising a plurality of spaced anode segments arranged to define a substantially cylindrical space charge chamber, said segments defining gaps therebetween said segments and said gaps having such widths that more than two successive gap-to-gap spacings are different from one another and means for coupling said segments to a broadly tuned output circuit.

7. A magnetron discharge device comprising a plurality of pairs of anode segments surrounding a centrally disposed elongated cathode in which each anode segment has a different width.

8. A magnetron discharge device comprising more than two pairs of anode segments surrounding a centrally disposed elongated cathode in which each pair of anode segments has a different width.

9. A magnetron discharge device comprising a plurality of anode segments surrounding a centrally disposed elongated cathode in which the widths of adjacent anode segments are provided with opposite axial tapers.

10. A magnetron oscillator for producing high frequency noise comprising a magnetron discharge device having a plurality of anode segments surrounding a centrally disposed elongated cathode, said segments and the interposed gaps having such widths that more than two successive gap-to-gap spacings differ, means for providing a high density space charge in the space bebtween said cathode and anode segments, means for imparting an average angular velocity about the cathode to said space charge comprising means for establishing a static axial magnetic field and a radial electric field within said space, and means for coupling a broadly tuned resonant output system to said anode electrodes.

11. An electrical discharge device of the magnetron type for generation of noise oscillations comprising a helical coil constituting a portion of the resonant circuit, a cathode positioned within said spiral coil, and a plurality of electrodes positioned adjacent the inner periphery of said spiral coil, each of said electrodes being conductively connected to a different point on said spiral coil and spaced from each other to provide gaps between them, said electrodes and the interposed gaps having such widths that more than two successive gap-to-gap spacings are different.

12. An electrical discharge device of the magnetron type for generation of noise oscillations comprising a helical coil constituting a portion of a resonant circuit, a cathode positioned centrally within said spiral coil, and a plurality of anodes positioned adjacent the inner periphery of said spiral coil in a generally cylindrical configuration about said cathode, each of said anodes being conductively supported from a different point on said spiral coil and at least three of said electrodes having dissimilar widths to cause varying transit times of electrons traveling around said cathode and past said electrodes.

* * * * *